US009752729B2

(12) United States Patent
Sawchuk

(10) Patent No.: US 9,752,729 B2
(45) Date of Patent: Sep. 5, 2017

(54) SYSTEMS AND METHODS FOR GENERATING SWIRL IN PIPELINES

(71) Applicant: Canada Pipeline Accessories, Co. Ltd., Calgary (CA)

(72) Inventor: Daniel A. Sawchuk, Chestermere (CA)

(73) Assignee: Canada Pipeline Accessories, Co. Ltd., Calgary, Alberta (CA)

( * ) Notice: Subject to any disclaimer, the term of this patent is extended or adjusted under 35 U.S.C. 154(b) by 82 days.

(21) Appl. No.: 14/741,502

(22) Filed: Jun. 17, 2015

(65) Prior Publication Data

US 2016/0003416 A1 Jan. 7, 2016

Related U.S. Application Data

(60) Provisional application No. 62/021,300, filed on Jul. 7, 2014.

(51) Int. Cl.
*F17D 1/20* (2006.01)

(52) U.S. Cl.
CPC ..... *F17D 1/20* (2013.01)

(58) Field of Classification Search
CPC ..... F17D 1/20
USPC ..... 138/39, 44
See application file for complete search history.

(56) References Cited

U.S. PATENT DOCUMENTS 2,553,141 A * 5/1951 Maynard ..... F15D 1/0005 138/37
3,545,492 A 12/1970 Scheid
3,791,414 A 2/1974 Anand et al.
3,838,598 A 10/1974 Tompkins
4,715,395 A 12/1987 Mainelli et al.
5,327,941 A 7/1994 Bitsakis et al.
5,341,848 A 8/1994 Laws
5,400,828 A 3/1995 Ziu et al.
5,495,872 A 3/1996 Gallagher et al.
5,529,093 A 6/1996 Gallagher et al.
5,606,297 A 2/1997 Phillips
5,762,107 A 6/1998 Laws
5,959,216 A 9/1999 Hocquet et al.
6,029,912 A 2/2000 Woolley
6,494,105 B1 12/2002 Gallagher
6,651,514 B2 11/2003 Zanker
6,807,986 B2 10/2004 Boger
6,851,322 B2 2/2005 Gallagher
(Continued)

FOREIGN PATENT DOCUMENTS

CA 2171828 3/1995
CA 2228928 8/1995
(Continued)

OTHER PUBLICATIONS

English Abstract of JP 55159831 dated Dec. 12, 1980.

*Primary Examiner* — Craig Schneider
*Assistant Examiner* — David Deal
(74) *Attorney, Agent, or Firm* — Cahn & Samuels, LLP

(57) ABSTRACT

A system for generating swirl includes a pipe and at least two orifice plates located within a section of the pipe and defining a swirl generation area. Each orifice plate has an off-set orifice or hole and is configured to have a position that is adjustable within the swirl generation area. Each orifice plate may be oriented at an angle variable to each other to generate a variable degree of swirl as fluid flow exits the swirl generation area.

20 Claims, 6 Drawing Sheets

(56) References Cited

U.S. PATENT DOCUMENTS

| | | | |
|---|---|---|---|
| 7,073,534 | B2 | 7/2006 | Sawchuk et al. |
| 7,089,963 | B2 | 8/2006 | Meheen |
| 7,464,611 | B2 | 12/2008 | Matter et al. |
| 7,845,688 | B2 | 12/2010 | Gallagher et al. |
| 8,132,961 | B1 | 3/2012 | England et al. |
| D697,581 | S | 1/2014 | Sawchuk et al. |
| D701,939 | S | 4/2014 | Sawchuk et al. |
| 8,763,644 | B2 | 7/2014 | Tsai et al. |
| D721,417 | S | 1/2015 | Sawchuk et al. |
| 2004/0055816 | A1 | 3/2004 | Gallagher et al. |
| 2005/0178455 | A1 | 8/2005 | Cancade et al. |
| 2005/0205147 | A1 | 9/2005 | Sawchuk et al. |
| 2006/0096650 | A1 | 5/2006 | Sawchuk et al. |
| 2008/0037366 | A1 | 2/2008 | Smith |
| 2008/0246277 | A1 | 10/2008 | Gallagher et al. |
| 2009/0277974 | A1 | 11/2009 | Citrawireja et al. |
| 2010/0024910 | A1 | 2/2010 | Nakamori et al. |
| 2011/0076628 | A1 | 3/2011 | Miura et al. |
| 2011/0174407 | A1 | 7/2011 | Lundberg et al. |
| 2011/0174408 | A1 | 7/2011 | Lundberg et al. |
| 2012/0247223 | A1 | 10/2012 | Sawchuk et al. |
| 2014/0110094 | A1 | 4/2014 | Pagan Duran |
| 2014/0196535 | A1 | 7/2014 | Sawchuk et al. |
| 2015/0083262 | A1 | 3/2015 | Van Buskirk |
| 2016/0061372 | A1 | 3/2016 | Sawchuk |

FOREIGN PATENT DOCUMENTS

| | | | |
|---|---|---|---|
| CA | 2787659 | | 7/2011 |
| GB | 1469648 | | 4/1977 |
| JP | 55159831 | A | 12/1980 |
| WO | 2014040191 | A1 | 3/2014 |
| WO | 2014110673 | A1 | 7/2014 |
| WO | 2014186883 | A1 | 11/2014 |

* cited by examiner

SYSTEMS AND METHODS FOR GENERATING SWIRL IN PIPELINES

This application claims priority to U.S. Ser. No. 62/021,300, filed in the U.S. Patent and Trademark Office on Jul. 7, 2014, the entirety of which is incorporated herein by reference.

FIELD OF INVENTION

The present disclosure generally relates to systems and methods for generating swirl in pipelines. More specifically, the present disclosure is related to systems and methods for generating swirl and/or flow disturbances using at least two orifice plates, each orifice plate having an off-set orifice or hole.

BACKGROUND OF INVENTION

The flow of liquids, gases, and/or fluids through pipes is widespread in a variety of industries and industrial applications including, but not limited to, heavy and light chemicals, steel, paper, nuclear, petrochemicals, turbomachinery, and various pipeline systems. In certain circumstances, flow through a pipe can be subject to a variety of flow disturbances, such as swirl. Swirl may have a tendency to propagate for significant distances downstream and therefore may necessitate the use of exceedingly long pipe lengths to control and/or mitigate the effects of swirl. However, in some instances it may be desirable to deliberately cause or generate swirl and/or flow disturbances in various fluid dynamics settings.

More specifically, it can be beneficial to intentionally generate swirl in a controlled environment in order to investigate, inter alia, the performance of flow meters and/or flow conditioners in an effort to improve their overall performance. By generating swirl in a controlled environment, the response of flow meters and/or flow conditioners to swirl can be tested, examined, and potentially modified. In addition, flow material behavior and response under various flow conditions can also be studied by intentionally generating swirl.

Although various methods for generating swirl exist, these methods are hindered by limitations in that they: (1) are limited to generating only certain degrees of swirl; (2) are limited by a fixed geometry and therefore locked into a specific swirl angle; and/or (3) are limited by being velocity sensitive. For example, sets of turbine blades and/or guide vanes can be used to generate swirl. However, this approach to swirl generation requires a fixed geometry and is further restricted by being velocity sensitive (e.g., vortex shedding and stalling at certain velocities tend to occur).

Accordingly, there exists a need for systems and methods for generating swirl that are capable of adjusting the degree and amount of swirl generated in controlled circumstances, and which do not contain the above-described limitations. Moreover, it would advantageous for systems and methods to be reliable, repeatable, applicable for a variety of flow conditions, fluid-dynamically verifiable, easily changeable to provide for different levels or degrees of swirl, and cost effective.

SUMMARY OF THE INVENTION

The invention provides in an embodiment a system for generating swirl characterized by a pipe and at least two orifice plates located within a section of the pipe and defining a swirl generation area. Each orifice plate has an off-set orifice or hole and is configured to have a position that is adjustable within the swirl generation area. Each orifice plate is oriented at an angle variable to each other to generate a variable degree of swirl as fluid flow exits the swirl generation area.

The invention provides a further embodiment to any of the previous embodiments a system further characterized by a directional baffle connected to one orifice plate and extending into the swirl generation area.

The invention provides a further embodiment to any of the previous embodiments a system characterized in that the off-set orifice or hole has a diameter in a range of approximately 30 to 50% of an inner pipe diameter.

The invention provides a further embodiment to any of the previous embodiments a system characterized in that the at least two orifice plates each further comprise a handle, the off-set orifice or hole being off-center on a face on the orifice plate toward the handle.

The invention provides a further embodiment to any of the previous embodiments a system characterized in that the at least two orifice plates each further comprise a handle, the off-set orifice or hole being off-center on a face on the orifice plate away from the handle.

The invention provides in an embodiment a method for generating swirl in a material flow. A system for generating swirl is provided characterized by a pipe and at least two orifice plates located within a section of the pipe and defining a swirl generation area. Each orifice plate has an off-set orifice or hole and is configured to have a position that is adjustable within the swirl generation area. Each orifice plate is oriented at an angle variable to each other to generate a variable degree of swirl as fluid flow exits the swirl generation area. Material flow enters through a pipe inlet section, passes through the swirl generation area, exits the swirl generation area, and enters a pipe outlet section. Swirl is generated in the material flow by positioning the at least two orifice plates at a variable angle of orientation with respect to each other.

The invention provides a further embodiment to any of the previous method embodiments a method further characterized by providing a directional baffle connected to one orifice plate and extending into the swirl generation area.

The invention provides a further embodiment to any of the previous method embodiments a method characterized in that the at least two orifice plates are rotated from 0 to 90 degrees relative to an initial starting location in the swirl generation area.

The invention provides a further embodiment to any of the previous method embodiments a method characterized in that the at least two orifice plates each further comprise a handle, the off-set orifice or hole being off-center on a face on the orifice plate toward the handle.

The invention provides a further embodiment to any of the previous method embodiments a method characterized in that the at least two orifice plates each further comprise a handle, the off-set orifice or hole being off-center on a face on the orifice plate away from the handle.

BRIEF DESCRIPTION OF THE DRAWINGS

The present disclosure may be better understood, and its numerous features and advantages made apparent to those skilled in the art by reference to the accompanying drawings.

DETAILED DESCRIPTION OF THE INVENTION

Figure 1:
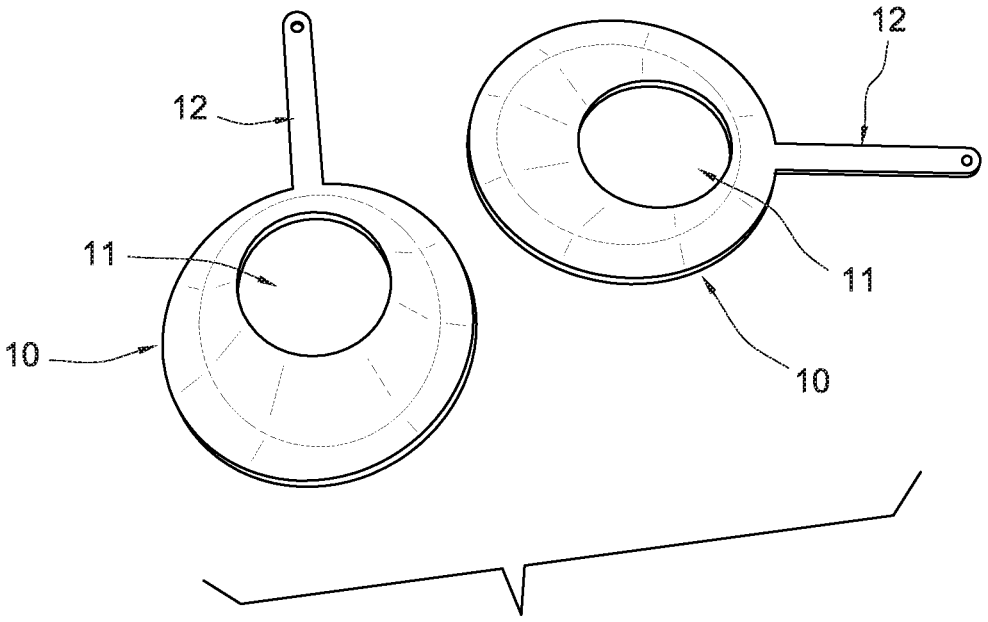
FIG. 1 is a perspective view of two orifice plates according to an embodiment of the present invention.

Orifice plates are typically used for the measurement, adjustment, and control of fluid flow. Orifice plates are typically mounted between a set of orifice flanges and are installed in a straight run of a smooth pipe.

In relation to fluid dynamics, flow through an orifice plate undergoes changes in velocity and pressure. Keeping in mind various assumptions (e.g., horizontal pipe, steady flow, incompressible flow, with no friction or losses), as fluid passes through an orifice the fluid will generally converge. As this happens, the velocity of the fluid will increase and at the same time experience a pressure drop. As the fluid exits the orifice and continues to travel downstream, the fluid will begin to diverge. As this happens, the velocity of the fluid will decrease and the pressure generally increases.

The present invention includes a system for generating swirl in a pipeline. Systems of the present invention include a pipe having an inlet section and an outlet section; at least two orifice plates, each orifice plate having an off-set (i.e., off-center) orifice or hole. The area between the at least two orifice plates defines a swirl generation area.

In specific embodiments, the system may include a plurality of orifice plates located within a section of pipe. Thus, the system may include three orifice plates, four orifice plates, etc., positioned at varying angles and separation distances from each other to achieve a variable desired degree of swirl.

In specific embodiments, the inlet pipe section, outlet pipe section, and/or the swirl generation area may have a diameter of about 2 to about 40 inches. The at least two orifice plates can be separated by a distance of 2.5 D to 5 D, where D refers to internal pipe diameter.

In embodiments, the diameter of the off-set orifice or hole may be about 30 to about 50% of the internal pipe diameter. In embodiments, the location of the off-set hole or orifice may be considered tangent to an inside wall of the pipe.

The orifice plates may be made of steel, Monel alloys, Hastelloy® metal alloys, stainless steel, water-jetted sheet metal, steel having high nickel content, combinations thereof, or any suitable material.

In specific embodiments, the off-set orifice or hole may be located closer to or further away from a handle of the orifice plate.

Regarding types of material flow, embodiments of the present invention can be configured to accommodate flow material that is primarily liquid, primarily gas, fluid flow, flow with solid components, slurries, liquid and solid flow, liquid, gas, and the like.

According to the present invention, each orifice plate may have a position that is adjustable within the swirl generation area. In embodiments, each orifice plate may be capable of rotating, for example from 0 to 90 degrees, relative to an initial starting location in the swirl generation area via the handles. By allowing the orifice plates to each have adjustable locations, varying degrees of swirl can be generated and different levels of flow disturbance can be created.

An orifice plate may include a directional baffle. In specific embodiments, a directional baffle may be connected to an upstream orifice plate (e.g., an orifice plate upstream of the swirl generation area). The directional baffle can be configured in a system such that the directional baffle operates to prevent flow from traveling in an opposite direction of an intended direction of flow, which would undesirably cancel out the generated swirl. In specific embodiments, a directional baffle may be in the shape of one or more flat plates.

With reference to FIG. 1, a front perspective view of two orifice plates 10 according to embodiment of the present invention is illustrated. Each orifice plate comprises an off-set orifice or hole 11 that is offset on the face of the orifice plate 10 toward the location of handle 12. Therefore, in specific embodiments, the orifice plates of FIG. 1 may be used for material flow of a liquid containing gas, or material flow where the primary phase is a liquid.

Figure 2:
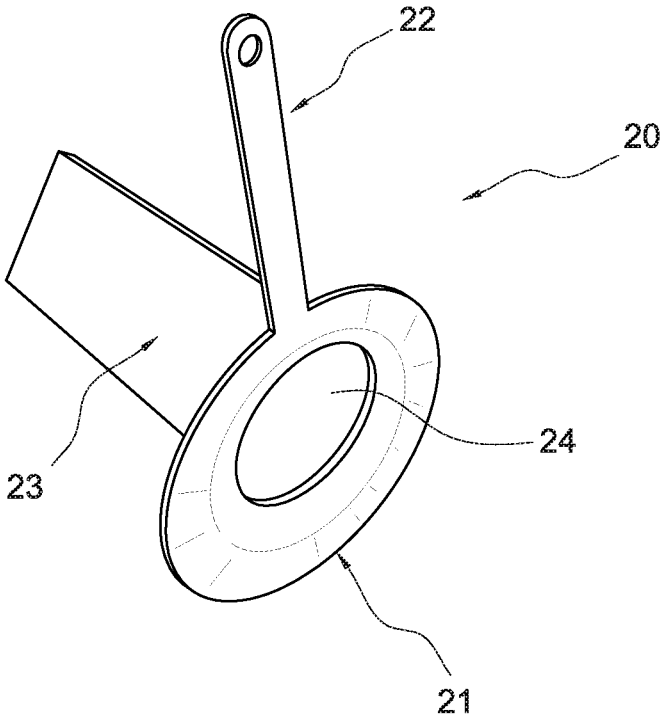
FIG. 2 is an illustration of an orifice plate having a directional baffle according to an embodiment of the present invention.

With reference to FIG. 2, orifice plate 21 includes off-set orifice or hole 24, a handle 22, and a directional baffle 23. In embodiments, the directional baffle 23 may be provided to prevent back flow and ensure that the swirl is created in a constant flow direction. In embodiments, the directional baffle 23 may be welded to the orifice plate 21. It will be appreciated by one of ordinary skill that other means for connecting the directional baffle to the orifice plate can be used as known in the art.

Figure 3:
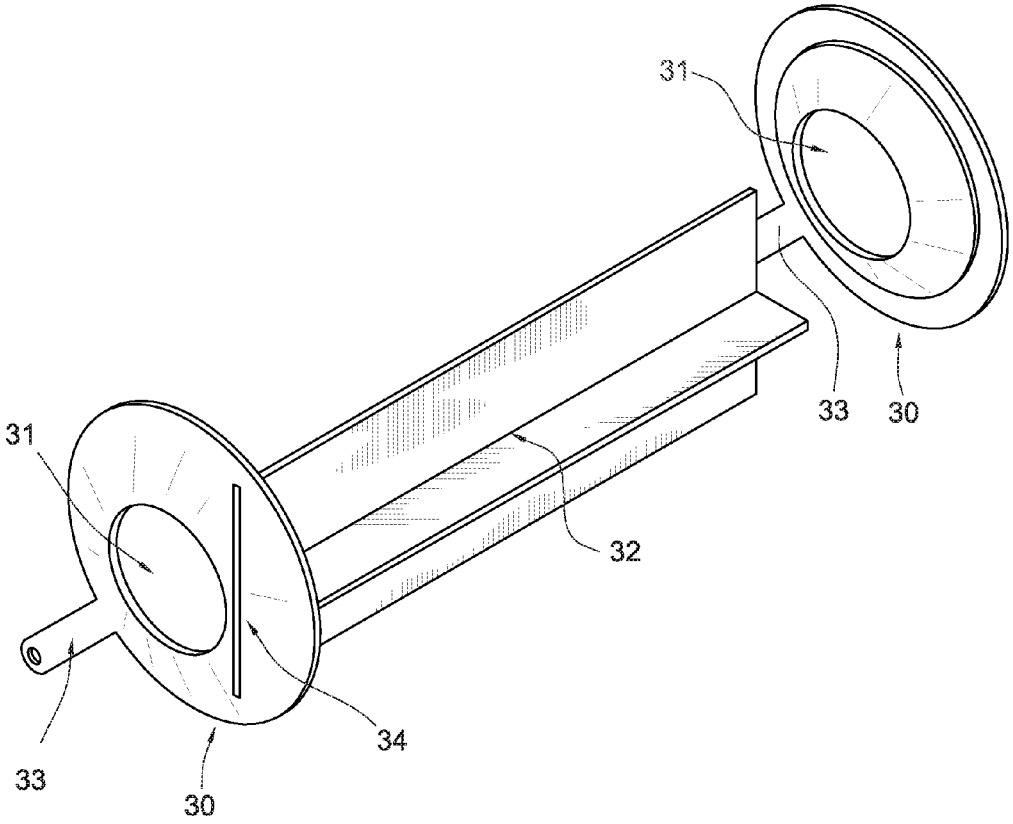
FIG. 3 is a diagram of two orifice plates and a directional baffle according to an embodiment of the present invention.

With reference to FIG. 3, a diagram of at least two orifice plates 30 is illustrated. Each of the at least two orifice plates 30 includes an off-set orifice or hole 31. The orifice plates 30 also include a handle 33. At least one of the orifice plates 30 includes a location 34 for connection to directional baffle 32. In embodiments, the direction baffle 32 can be welded to an upstream orifice plate.

Figure 4:
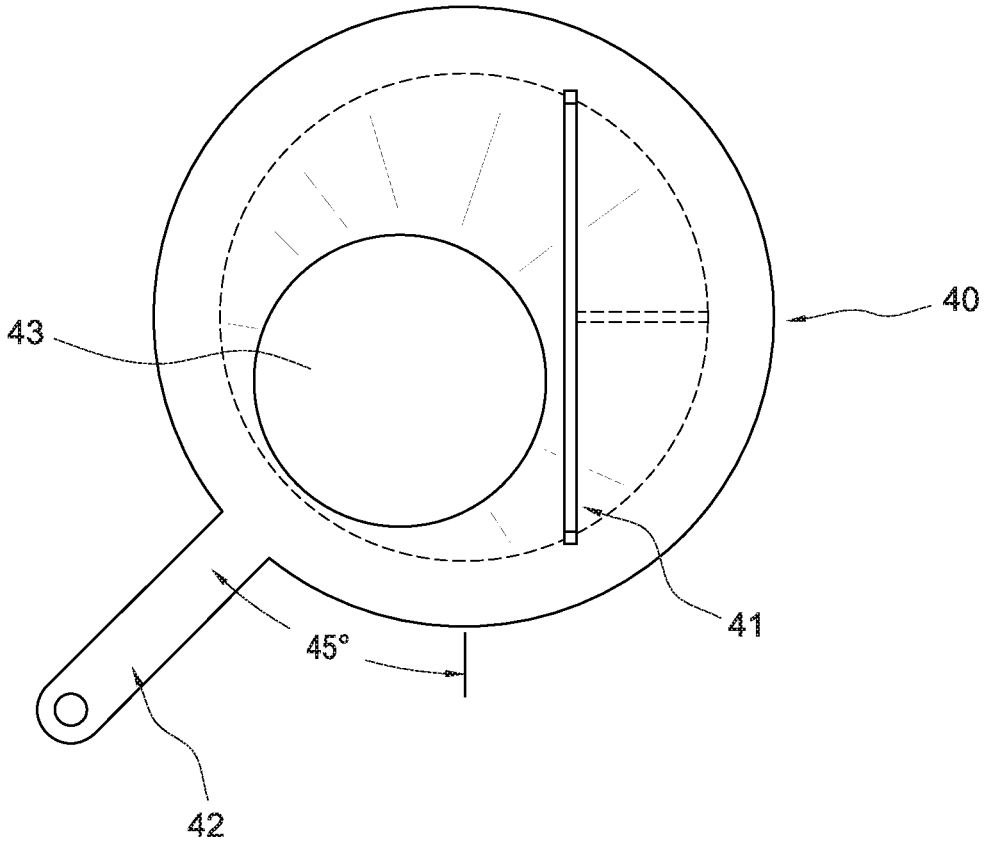
FIG. 4 is an illustration of an orifice plate according to another embodiment of the present invention.

With reference now to FIG. 4, a diagram of an orifice plate 40 according to another embodiment of the present invention is illustrated. Similar to one of the orifice plates 30 of FIG. 3, orifice plate 40 includes a location 41 where a directional baffle can be connected. Orifice plate 40 includes an off-set orifice or hole 43 and handle 42. The handle 42 may be used to adjust the position of the orifice plate and off-set orifice 43, for example by 45°, relative to an initial position.

System embodiments of the present invention can be configured such that flow entering the swirl generation area and traveling in a direction that is axial with respect to the inlet pipe section exits the swirl generation area having a generated degree of swirl. The degree of swirl may be a function of at least one of orifice diameter, plate separation distance, or angle position of the plates. In some embodiments, systems can generate about 5 to about 45 degrees of fluid swirl as measured downstream, for example 10 D downstream, from the swirl generation area. The swirl angle is measured relative to an axial velocity angle. It is calculated using the axial flow component and a transverse component of the swirl. As noted, the degree of swirl may be adjusted by changing the positioning of the plates, orifice diameter, and/or plate separation distance.

System embodiments of the present invention may be configured such that the flow exiting the swirl generation area is rotationally symmetrical about an axis which is coaxial with the inlet pipe (e.g., about a longitudinal axis of the pipe).

Figure 5:
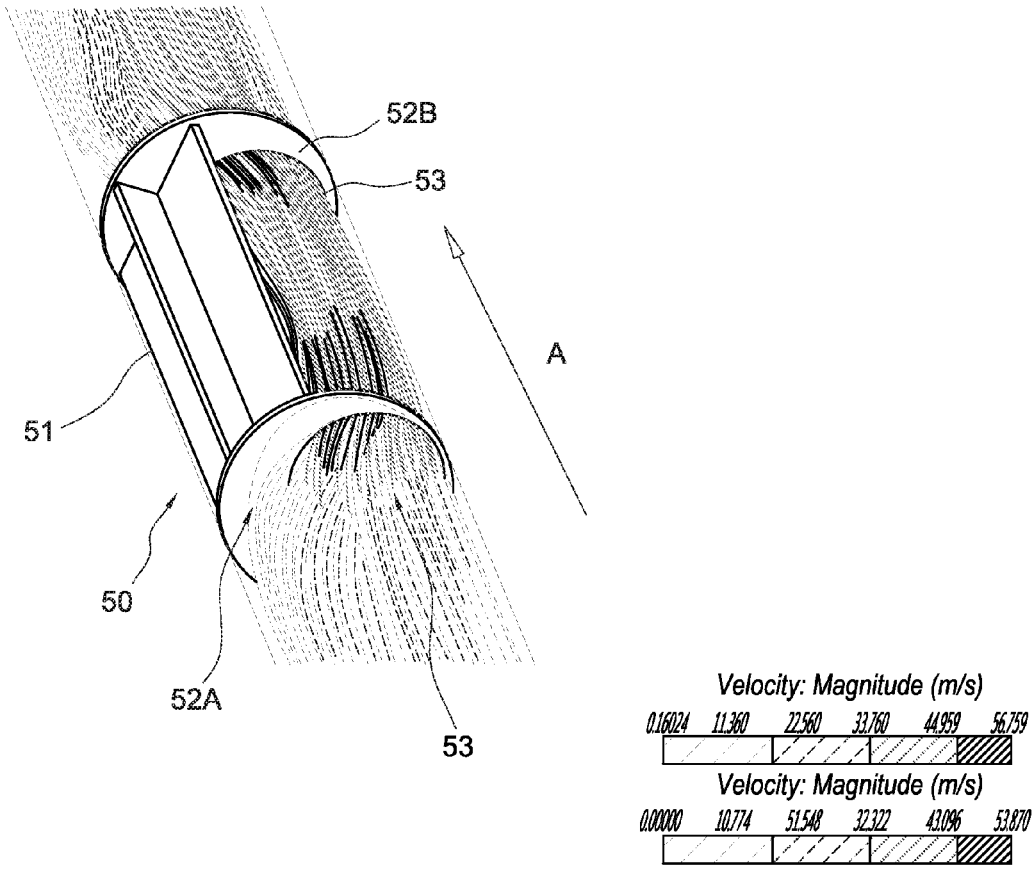
FIG. 5 is an illustration of a flow profile through a swirl generation area according to an embodiment of the present invention.

FIG. 5 provides an illustration of a flow profile through swirl generation area 50 between two orifice plates 52A, 52B, each having an off-set orifice or hole 53 according to an embodiment of the present invention. A material flow moves through swirl generation area 50 in a direction shown by arrow A. The swirl generation area includes a directional baffle 51 connected to an orifice plate 52A. Swirl is generated as the material passes through the orifice plates 52A, 52B and directional baffle 51. Accordingly, the flow that exits the second orifice plate has a selected degree of swirl.

Figure 6:
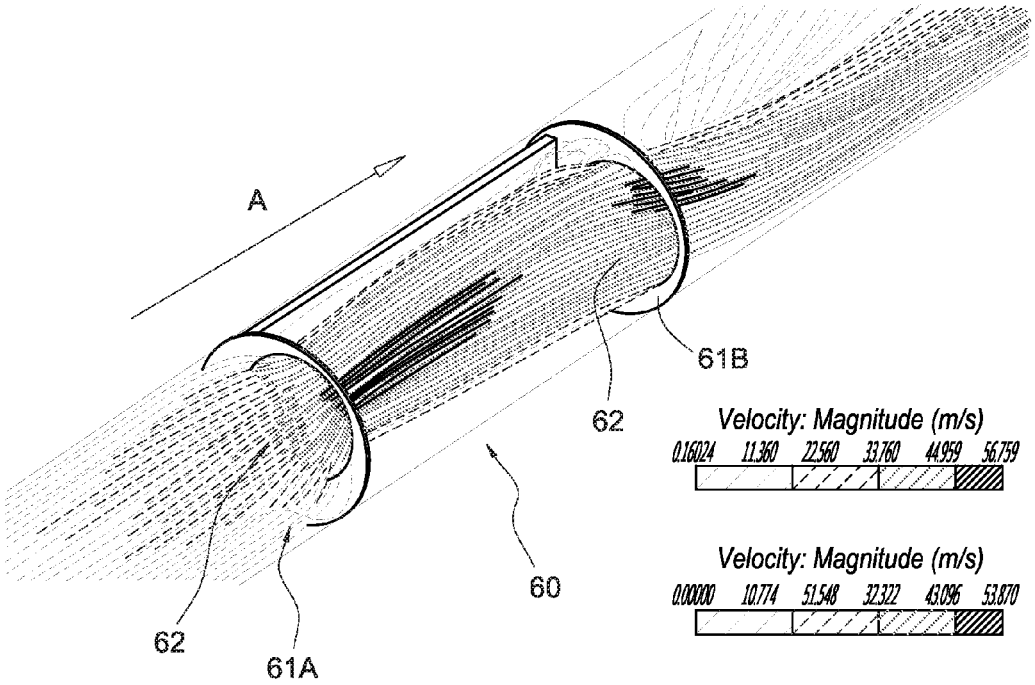
FIG. 6 is an illustration of a flow profile through a swirl generation area according to another embodiment of the present invention.

FIG. 6 provides another illustration of a flow profile through swirl generation area 60 according to another embodiment of the present invention. The swirl generation area is defined by two orifice plates 61A, 61B, each having an off-set orifice or hole 62. Material flows through the swirl generation area 60 in a direction indicated by arrow A. As shown, material exiting the first orifice plate 61A and material exiting the second orifice plate 61B have a selected degree of generated swirl.

EXAMPLE

The following table provides an example of swirl generation according to a non-limiting embodiment of the present invention, in which two orifice plates having off-set holes were separated by 30 inches in a section of pipe having a 12 inch inner pipe diameter. The off-set holes had a 35% opening in the plates relative to the inner pipe diameter.

TABLE 1

Example Degrees of Swirl Generation
Degrees of Swirl

| Degrees of Plate Separation | Downstream Distance from System D = Pipe Diameter | | |
|---|---|---|---|
| — | 8D | 10D | 15D |
| 11.25° | 6.23° | 5.75° | 4.46° |
| 22.5° | 11.43° | 10.87° | 6.69° |
| 45° | 14.57° | 16.43° | 15.34° |

The present invention includes methods for generating swirl and/or flow disturbance in a flow. Methods of the present invention include providing a system including an inlet pipe section, an outlet pipe section, and at least two orifice plates having an off-set orifice or hole and separated by a length of pipe. The methods may include generating swirl in a material flow by positioning the at least two orifice plates at a variable angle of orientation relative to each other, for example, by measurement of the angle between the handles. A flow meter may measure the effect of generated swirl on at least one of flow meter performance, ultrasonic signal transit time, orifice plate pressure differential, turbine meter blade speed, and the like.

As referenced above, systems and methods of the present invention can be used to generate swirl and/or flow disturbances in a controlled environment to, inter alia, study the performance of flow conditioners and/or flow meters under varied flow conditions. As such, embodiments of the present invention may include an apparatus for studying flow performance. The apparatus can include a system for flow generation, as described above, and a channel or conduit for receiving the swirl generated flow from the system. The swirl generated flow can enter the channel or conduit from the outlet pipe section. Apparatuses for studying flow performance according to the present invention may also include a measuring device for measuring at least one characteristic, parameter, and/or measurable variable related to the swirl generated flow.

The present invention is capable of generating differing amounts of fluid swirl in a set environment, with systems and methods that are fluid dynamically verified, controllable, adjustable, variable, versatile, reliable, economically feasible, and repeatable. The reliable adjustability of systems and methods of the present disclosure further allows for users to fit the invention into existing piping systems and/or flow systems, thereby minimizing the need for acquiring, inter alia, specified pipe fittings or specified configurations to address and provide different types or degrees of swirl, etc.

Furthermore, unlike methods found in the art, embodiments of the present invention are not locked or limited into a fixed geometry and are capable of being adjusted such that a single system or device of the present invention can be used to generate multiple amounts and/or degrees of swirl in an adjustable, reliable, and repeatable fashion.

In view of the foregoing, systems and methods of the present invention can be utilized to study and investigate the performance of flow meters and/or flow conditioners in an effort to, inter alia, improve performance their metrics and design.

As used herein "substantially", "relatively", "generally", "about", and "approximately" are relative modifiers intended to indicate permissible variation from the characteristic so modified. They are not intended to be limited to the absolute value or characteristic which it modifies but rather approaching or approximating such a physical or functional characteristic.

In this detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention.

What is claimed is:

1. A system for generating swirl, comprising:

a pipe;

at least two circular orifice plates located perpendicular to a longitudinal axis of the pipe and defining a swirl generation area, each orifice plate comprising an off-set orifice or hole and being configured to have a position that is adjustable within the swirl generation area, and a directional baffle connected to one orifice plate and extending into the swirl generation area, wherein each orifice plate is oriented at an angle variable to each other to generate a variable degree of swirl as fluid flow exits the swirl generation area.

2. The system according to claim 1, wherein the off-set orifice or hole has a diameter in a range of approximately 30 to 50% of an inner pipe diameter.

3. The system according to claim 1, wherein the at least two orifice plates each further comprise a handle, said off-set orifice or hole being off-center on a face on the orifice plate toward the handle.

4. The system according to claim 1, wherein the at least two orifice plates each further comprise a handle, said off-set orifice or hole being off-center on a face on the orifice plate away from the handle.

5. The system according to claim 1, wherein the at least two orifice plates are spaced about 2.5 D to about 5 D apart, wherein D is a diameter of the pipe.

6. The system according to claim 1, comprising a plurality of orifice plates.

7. The system according to claim 1, wherein at least one of a pipe inlet section, a pipe outlet section, or the swirl generation area has a diameter of about 2 to about 40 inches.

8. The system according to claim 1, wherein the directional baffle comprises one or more flat plates.

9. The system according to claim 8, wherein one flat plate extends along a length of another flat plate.

10. The system according to claim 8, wherein the directional baffle comprises two flat plates.

11. The system according to claim 1, wherein the directional baffle extends from an upstream orifice plate into the swirl generation area.

12. The system according to claim 1, wherein the off-set orifice or hole is on a face of the orifice plate.

13. The system according to claim 1, wherein the off-set orifice or hole is tangent to an inside wall of the pipe.

14. A method for generating swirl in a flow, comprising:

providing a system according to claim 1;

material flow entering through a pipe inlet section, passing through the swirl generation area, exiting the swirl generation area, and entering a pipe outlet section;

generating swirl in the material flow by positioning the at least two orifice plates at a variable angle of orientation relative to each other.

15. The method according to claim 14, wherein the at least two orifice plates are rotated from 0 to 90 degrees relative to an initial starting location.

16. The method according to claim 14, wherein the at least two orifice plates each further comprise a handle, said off-set orifice or hole being off-center on a face on the orifice plate toward the handle.

17. The method according to claim 14, wherein the at least two orifice plates each further comprise a handle, said off-set orifice or hole being off-center on a face on the orifice plate away from the handle.

18. The method according to claim 14, wherein the at least two orifice plates are spaced about 2.5 D to about 5 D apart, wherein D is a pipe diameter.

19. The method according to claim 14, wherein the off-set orifice or hole has a diameter in a range of approximately 30-50% of an inner pipe diameter.

20. The method according to claim 14, wherein the swirl-generated flow has a direction of flow deflected by about 5 to about 45 degrees from an initial direction of flow prior to passing through the swirl generation area.

* * * * *